United States Patent [19]

Marz

[11] Patent Number: 4,898,066

[45] Date of Patent: Feb. 6, 1990

[54] POLYMERIC FILM ENVELOPED EXPLOSIVE CARTRIDGES AND THEIR MANUFACTURE AND USE

[75] Inventor: Horst F. Marz, Otterburn Park, Canada

[73] Assignee: C-I-L Inc., North York, Canada

[21] Appl. No.: 385,441

[22] Filed: Jul. 25, 1989

Related U.S. Application Data

[62] Division of Ser. No. 150,979, Feb. 1, 1988, Pat. No. 4,872,408.

[30] Foreign Application Priority Data

Mar. 25, 1987 [CA] Canada ..... 532930

[51] Int. Cl.[4] ..... F42B 3/00

[52] U.S. Cl. ..... 86/20.1; 102/324

[58] Field of Search ..... 86/20.1, 20.11, 20.13, 86/29; 102/324

[56] References Cited

U.S. PATENT DOCUMENTS

| | | | |
|---|---|---|---|
| 94,847 | 9/1869 | Shaffner | 86/20.1 |
| 119,330 | 9/1871 | Dickey | 102/324 |
| 1,000,663 | 8/1911 | Bickel | 86/20.1 |
| 2,179,373 | 11/1939 | Hitt | 86/20.1 |
| 2,911,910 | 11/1959 | Welsh | 102/324 |
| 3,320,847 | 5/1967 | Kelly et al. | 86/20.1 |
| 4,052,939 | 10/1977 | Simmons et al. | 102/323 |

*Primary Examiner*—David H. Brown

*Attorney, Agent, or Firm*—C. Brian Barlow

[57] ABSTRACT

An improved plastic film cartridge for flowable explosives is provided. The cartridge comprises a recessed or indented end configuration which recess can be enlarged to provide a locating and retaining pocket for a blasting cap without any penetration of the cartridge film wall. The recess is maintained by means of an internal, elastic cord or strip attached between the sealed ends of the cartridge.

1 Claim, 2 Drawing Sheets

POLYMERIC FILM ENVELOPED EXPLOSIVE CARTRIDGES AND THEIR MANUFACTURE AND USE

This is a division of Ser. No. 150,979, filed 2/1/88, now U.S. Pat. No. 4,872,408.

The present invention relates to modified, enveloped explosives charges. More particularly, the invention relates to thermoplastic film cartridges of explosives.

Explosives for use in blasting in mining and construction have been most commonly packaged as cylindrical cartridges. This cartridge shape was adopted for convenience in filling drill holes in rock. In regular blasting, each drill hole contains one or more cartridges at least one of which is primed with a blasting cap. The initiation of the primed cartridge causes the subsequent explosion of all the other cartridges in the same hole.

The primed cartridge is generally a regular charge in which a hole has been punched toward or at one end with, for example, a pointed metal spike, the punch hole being centrally placed along or slightly inclined to the cylinder axis. The punch hole is of sufficient diameter and depth to snugly accommodate a blasting cap.

With traditional explosives of the dynamite type, this method of priming of a cartridge is simple and most reliable. The explosives are of a soft, easy to punch consistency but are, nevertheless, relatively rigid. The packaging material is commonly waxed paper or cardboard which is easily punctured and the cartridges are sufficiently rigid to maintain their shape during loading into boreholes.

Traditional paper-cartridged, nitroglycerine-based explosives are relatively expensive to manufacture, handle, transport and store. This is due to their hazardous shock sensitivity, effects resulting from their toxic nature and their limited shelf life. Also, the performance of charges which are slept for a long time in wet holes is often unreliable. This can be a particularly troublesome problem in, for example, seismic exploration in remote areas.

Explosives have been developed which suffer few of the disadvantages described above. Examples of these are explosives containing gelled nitrate/water solutions or inverted emulsions of nitrate solutions in oil. These newer explosive types are generally unsuited to packaging in paper or cardboard because water, which is an ingredient, affects the structural strength of cellulose based packages. While generally more resistant to water, the explosives themselves are not completely waterproof and they require some protection from prolonged exposure to water in boreholes.

As a result of a need for water resistance, rigid impervious moulded polymeric (plastic) cartridges have been developed. Such a cartridge is described, for example, in U.S. Pat. No. 2,340,695 to Rothrock. However, moulded cartridges are expensive to manufacture and are sometimes difficult to fill. Furthermore, when used with modern explosives, the cartridges generally interpose a desensitizing layer of rigid plastic between a detonator in a moulded cap well and the main charge. This can lead to unreliable initiation.

As a result of these factors, the more modern, low sensitivity explosives of the gel or emulsion type tend to be cartridged in flexible, thin, plastic film, sausage-shaped packages. These newer cartridges can be stored for long periods without serious deterioration and can be manufactured rapidly and very economically on automated equipment.

It is important that plastic film cartridges of the newer, more fluid explosives be consistently filled with accurately controlled quantities of explosives because the stiffness and consequent handling character of the cartridges depends greatly and, in some cases, completely on keeping the film in sufficient but not excessive tension. Sufficient tension, induced by internal pressure, makes possible the control of cartridge shape during manufacture and storage and eases loading into blast holes. Overfilling with explosives can result in bursting of the package during manufacture or loading. When gas bubble-sensitized explosives are cartridged, overfilling can result in high densities and consequent explosive failures. Underfilling can give out-of-round or flaccid cartridges which are impossible to load because they jam in the holes. This very accurate fill requirement is a constant production difficulty because of the rheology of the explosive being delivered into the package.

The filling needs are made more difficult with the quite commonly encountered incompressible explosives of the glass bubble or chemically sensitized types. Specially flexible film may be needed in these cases which films can, in turn, cause loading difficulties.

Reliable detonation of the cartridges requires that a cap or a cap and booster combination as the initiator, be placed in close, initiating contact with the charge. Hole-punching of the cartridge and insertion of a cap is possible but the explosive then may become exposed to water in the borehole. Furthermore, the cartridge may become flaccid and difficult to load because of explosive leakage. With very fluid explosives, the cap may even be displaced or ejected during loading.

Attempts to attach initiators without hole-punching by using a preformed tunnel in the enveloping tubing seam or by using adhesive tape have proved unreliable. This is because the cap is exposed to damage or easy dislodgement during loading.

There exists, therefore, a need for film cartridges which allow for minor under and overfilling and which show adequate stiffness or turgidity for easy loading even when used with low viscosity, non-setting or non-gelling explosives of the newer type. There is also a need for film cartridges which may be reliably primed with a cap or cap and booster combination even when long term exposure underwater is expected and for such primed cartridges to be easily loadable into blast holes without dislodgement of the primer.

It is an object of the present invention to provide a novel, plastic film-enveloped cartridge which may be slightly underfilled or overfilled without bursting or loading difficulties.

It is a further object of the invention to provide a novel, film-enveloped cartridge from which the primer is unlikely to be dislodged during loading into blast holes.

It is a yet further object of the invention to provide a film-enveloped cartridge which may be reliably primed without the need to penetrate the film and so expose the explosive to in-hole water.

Accordingly, the invention provides an improved explosive cartridge comprising a tubular, flexible, polymeric film envelope having a first sealed end and a second sealed end and containing a non-rigid explosive composition, the improvement comprising the first sealed end being everted into the body of the cartridge towards the second sealed end so as to provide an internal recess, the recess being maintained in the everted position by means of a cord-like tensioner connected between the said second sealed end and the said everted first sealed end, the length of the recess being sufficient to accommodate an explosion initiating device.

By flexible polymeric film is meant a thin and resilient easily flexed layer of thermoplastic or thermosetting polymer, such as, linear low density polyethylene sheet or a laminate containing layers of films. By non-rigid explosive charge is meant a fluid or flowable explosive material which will propagate an incident detonation or shock wave through its mass with simultaneous substantial energy release. By tensioner is meant an internal cord-like element which physically attaches one end of the film envelope to the other end in such a way that tension is induced in the film and the tensioner. Such a tensioner may be formed from, for example, an elastic strip, string, cord or film tube attached under tension between the closures of a tubular envelope enclosing the charge. The tensioner is usually a single strand or strip of polymeric material but it may, for example, comprise more than one strand stretched between internal points so as to give substantially the same internal cartridge pressure over a very wide range of charge size variations.

There is also provided an improved explosive cartridge of the type described wherein the tensioner is of greater elasticity than the film envelope. By providing a tensioner of greater elasticity, the inevitable variations in charge size which occur when filling the cartridges can be taken up by stretching or shrinking of the tensioner without loss of cartridge turgidity regardless of explosive rheology and envelope film resiliency.

The everted first sealed end of the cartridge creates an elongated recess or cavity in the cartridge end into which an initiating blasting cap can be inserted without any penetration of the film wall. The recess is created and maintained by the internal tensioner and the length of the tensioner is adjusted so as to pull the first cartridge end inside the explosive charge thus forming a reentrant or everted configuration end to the cartridge. Such a cartridge can have its internal pressure maintained by the action of the tensioner or the tensioner can be effectively inextendible and merely act as a restrainer for the recess. In either case, the tensioner prevents the recess and its content, if any, from being expelled from the body of the cartridge by the internal pressure. With a regular cylindrical cartridge of the present invention, recesses can be produced in both ends of the cartridge by simple manipulation though there is no particular advantage in having two recesses in any one cartridge.

There is, additionally, provided an improved explosive cartridge as described above, wherein the improvement comprises the internal tensioner means being formed from an additional length of envelope film. In this embodiment, the regular film comprises its own tensioner and is so made by doubling back a full extra length of the envelope casing so that a recess running the full length of the cartridge is provided. In this way, the first and second ends of the cartridge exist at the same point in space and may be held closed by a single clip is desired.

In order that the invention may be better understood and by way of example only, specific embodiments of the invention will now be described with reference to the drawings wherein.

Figure 1:
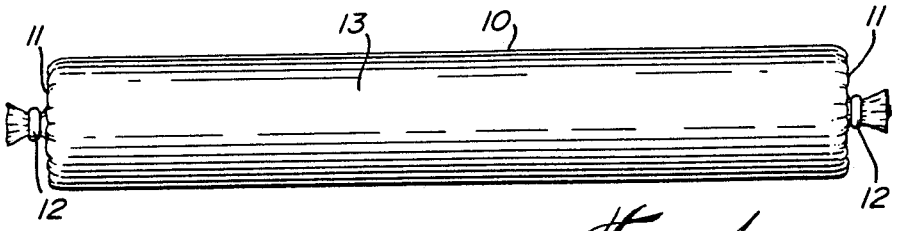
Fig. 1 PRIOR ART
FIG. 1 is a side view of a regular film encased slurry explosives cartridge according to the prior art.

In FIG. 1, a casing film of plastic 10 is shown enclosing a main cylindrical explosive charge 13 with gathered film 11 at each end of the cartridge. The film is shown trimmed and firmly held closed by metal clips 12 to form a regular, film enveloped, sausage-like, cartridge.

Figure 2:
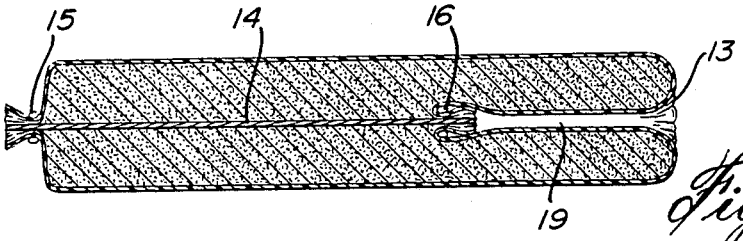
FIG. 2 shows a cross sectional view of a preferred embodiment of the cartridge of the invention showing a partly everted or reentrant end.

In FIG. 2 a first preferred embodiment of the present invention is shown. Film 13 is formed into regular end closures held by clips 15 and 16. A short length of a taut tensioner made from cord or strip 14 is mounted and held firmly between the clip closures 15 and 16. Because the cord 14 is shorter in length than the cartridge, one end closure, 16, is pulled inwardly into the body of the cartridge creating a cavity or recess 19.

Figure 3:
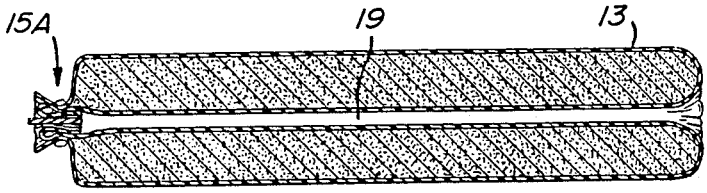
FIG. 3 shows a cross sectional view of an alternative embodiment of the cartridge of the invention showing a fully everted or reentrant single closure cartridge.

A second embodiment, which is a variation of that in FIG. 2, is shown in FIG. 3. In this embodiment, only one sealed end exists and an extra long casing serves the same purpose as the tensioner 14 in FIG. 2. The casing film 13 is turned back or everted internally and runs the whole length of the cartridge. A single clip 15A holds both ends of the film casing in this embodiment and the recess 19 runs the full length of the finished cartridge.

Both embodiments of the invention may be hand manufactured. With the cartridge of FIG. 2, the film tube is first positioned approximately vertically and then closed at the lower extremity on a centrally placed tensioner 14. Upward insertion of a rod (not shown) or pulling up on the tensioner cord or strip 14 converts the lower end 13 to the everted configuration. The tensioner 14 and the upper end of the tube are then held while explosives are added in the desired quantity. Air expulsion and final gathering and clipping at 15 is then performed.

In the case of an embodiment using an extra long length of casing as tensioner, the film 13 is first held vertically and, the lower end then passed coaxially up through the centre and upper part of the tube. Explosive is then delivered into the annular coaxial space while the two ends of the film are held and then air expulsion and clipping takes place firmly gripping both ends of the film.

Labour intensive, hand manufacturing techniques, such as the above, are appropriate and economic only with larger explosive charges of 75 mm and greater diameters. For smaller diameter cartridges, machine manufacture on modified regular equipment is required.

An example of suitable modified regular machinery capable of making cartridges of the type shown in FIG. 2 is described with reference to FIGS. 5 and 6. The particular example shown is commonly known under the manufacturer's trade name Kartridge Pak®. Referring to the Figure, conventional prior art cartridges, as shown in FIG. 1, are produced by a continuous feed of film from roll 21 and a continuous feed of explosives 29 entering at 31 and being discharged from filler tube 27.

A moving clipping table (not shown) operates at timed, short intervals to gather, double clip the film, and to cut the film between the clips thus forming regular sausage-shaped cartridges. It is most convenient to form the required tube from flat film strip immediately before filling. A roll of flat film strip 21 is fed over feed rollers 22 into a tube forming shoulder 23 which curls the film into an enveloping cylinder with an unsealed seam on the side of filler tube 27 opposite the roll 21. This seam is sealed using, for example, a heat sealer (not shown) which is mounted below the forming shoulder. The formed, seam-sealed film tube then passes downward and encloses the whole lower part of the filler tube 27. The film tube is moved forward at controlled speed by being gripped in front and behind the filler tube by two pairs of pinch rollers 24 (a front pair only are shown in FIG. 5). Fins 25 attached to the filler tube 27 spread the film out so that it can be nipped by the pinch rollers 24. Control of the speed of the pinch rollers 24 and of the explosives delivery pump (not shown) gives a well filled tube which is gathered and clipped to give cartridges of preset lengths which are acceptably full and rigid.

Figure 5:
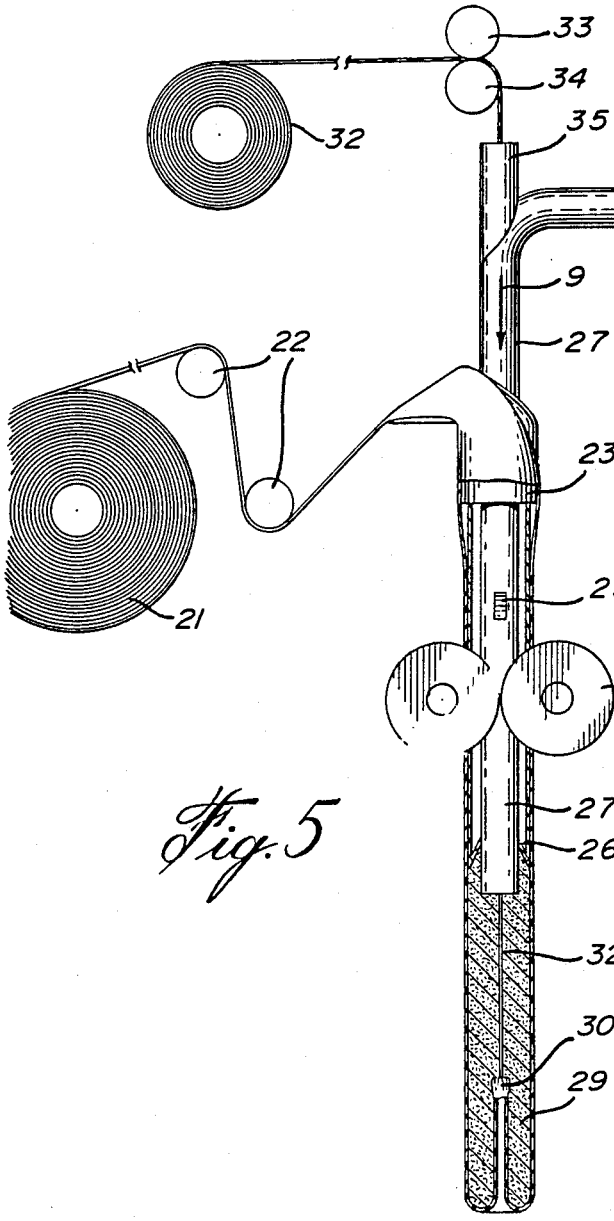
FIG. 5 is a partial side view of a cartridge forming machine adapted to form the cartridges of FIG. 2.
Figure 6:
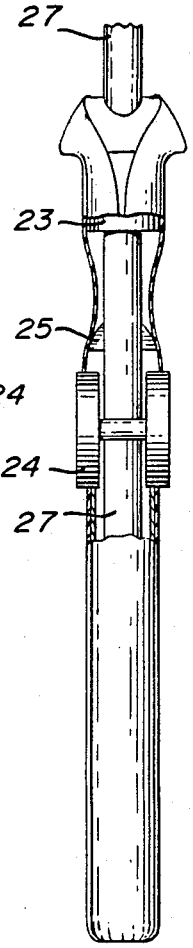
FIG. 6 is a partial sectional side elevation of FIG. 5.

Modifications in the described procedure and apparatus are required to produce the cartridges of the type shown in FIG. 2 and these modifications are shown mainly in the upper portion of FIG. 5. A spool of tensioner cord or strip 32 is fed continuously through driven rollers 33 and idler roller 34 to a narrow entry tube 35 and into the explosives filler tube 31. Leakage of pumped explosive 29 from entry tube 35 is found to be easily controlled by providing a narrow clearance for cord or strip 32 and by the forward feed of the cord or strip 32. Driven pinch wheel 33 is actuated by a cam mounted on the main cam shaft of a clipper drive (not shown) which starts and stops a hydraulic motor (not shown) to feed cord or strip 32 after a delay period from the start of each cartridge filling. Alternatively, the feed of cord 32 can be continuous but at an adjusted lower speed than the feed speed of the regular film 22. Combinations of these feed methods may be used to achieve the same desired result.

It has been found easier to obtain a good closure seal and a firmly gripped end connection 30 by using a strip 32 of plastic film of, for example, half an inch in width rather than by using cord. However, it is possible to use cord of natural fibre or synthetic origin with clipping force adjustment. A further optional modification which is useful with more fluid explosives is the use of retainer skirt or ring 26 which slows back leakage up the outside of the filler tube 27.

Adjustment of the feed rate of regular film 22, tensioner strip 32 and explosives 29 entering at 31 can be used to produce cartridges with any desired length of tensioner 32. It will be clear that cartridges of regular outward appearance as shown in FIG. 1 will result if the cord or strip 32 is fed at too high a rate and no tensioning results. However, even slight shortening and tensioning of the cord 32 is useful in maintaining manipulability of the cartridge by providing for filling inaccuracies even when the recess 19 shown in FIG. 2 is too small to accommodate a cap.

Surprising additional advantages result with the tensioner-containing cartridges of the invention. These are further explained as follows:

With regular film packaged cartridges as shown in FIG. 1, it is usually necessary to select films which are strong, waterproof and abrasion resistant. In particular, the cartridges must resist expansion in diameter caused by film stretching or they will become prone to jamming during borehole loading. Friction between cartridge and the borehole wall must be overcome by force exerted by the cartridge loading push rod. These forces result in extra internal cartridge pressure being developed. Bulging and consequent jamming and, sometimes, premature bursting of the cartridge may occur unless a strong film envelope is selected. However, the use of strong, hard-to-stretch film which avoids the above-noted problems, causes explosives filling difficulties with regular film cartridges. A very precisely controlled amount of explosive must be delivered to properly fill each cartridge to the desired density and rigidity and this fine control or metering is difficult to accomplish. The use of the tensioner cord or strip 32 of the invention, which cord can easily be selected to be more easily stretchable than the film itself, can allow for much greater variation in the amount of explosives delivered into the cartridge since any extra explosives merely extends the cord or strip 32. Thus, overfilling with explosives tends to lengthen the novel cartridge of the invention without causing the previously noted rapid build-up of internal cartridge pressure, girth expansion, excessive density increases and consequent explosive failures or bursting during manufacture or borehole loading.

The cartridge of the invention is also particularly useful in maintaining ease of loading with slight underfilling. It is difficult or impossible to load flaccid or underfilled, non-turgid regular film cartridges into a borehole since they tend to fold over and jam when being inserted. An elastic, extendible tensioner can take up slack whether caused by slight underfilling with explosives or by temperature effects.

Use of the cartridges of the invention also add new freedom in explosives formulation in that the consistency of explosives used becomes less critical in achieving firm cartridges. The cartridge shape and firmness can be determined by the film and tensioner alone without regard to the explosives rheology provided appropriate internal cartridge pressure is achieved. This is also true with primed cartridges carrying an internal initiator.

A further significant advantage exists in that cartridge envelope film selection, in the case of the tensioner containing cartridge of the invention, can be made fully independently of any film elasticity considerations because the tensioner alone can provide any required degree of elasticity. In the case of the second embodiment shown in FIG. 3 where an extra length of film envelope is used, elasticity considerations are less independently adjustable. However, since a doubled length of film is employed, the cartridge can accommodate double the normal explosives fill variation without unacceptable distortion in cartridge diameter and related or consequent difficulties.

Those skilled in the field of packaging technology will also appreciate that a variety of mechanical or electrical variations in the tensioner feed mechanism or in the cartridge forming mechanism described heretofore can be made without altering the principle of the present invention.

Figure 4:
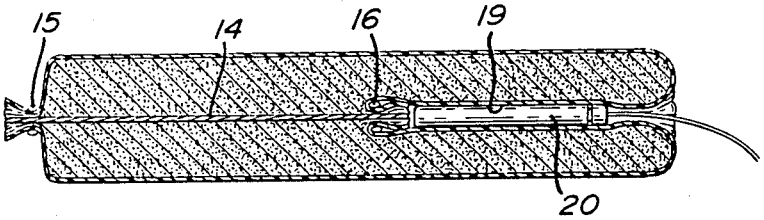
FIG. 4 shows the cartridge of FIG. 2 in cross section having had a blasting cap inserted therein.

In actual use, the cartridge as shown in FIG. 4 is primed by inserting the detonator 20 (with or without a booster charge as needed) in recess 19 where it is firmly held by the full radially inwardly exerted forces of the internal cartridge pressure. The embodiment shown in FIG. 3 is primed in an identical manner.

The detonator or initating charge 20, in this way, is held in intimate contact with the main charge separated from it only by the thickness of the film used. It will be readily apparent that the initiator is held in an axial position where its explosive force is fully and most efficiently exerted on the charge upon firing and from which position it is difficult to dislodge during borehole loading.

Since no puncture of the film is made, water induced desensitization is not possible and, as a consequence, explosives of considerably reduced water resistance may be used, if desired, even when long sleep times in wet holes are anticipated.

The existence of axial pockets such as described in the above preferred embodiments provides most reliable performance. The tensioner 14, as shown in FIGS. 2 and 4, need not be attached exactly in an axial position when strong, abrasion-resistant film envelopes are employed. However, substantially off-axis positioning of the tensioner 14 is to be avoided since difficult-to-load, curved cartridges may be produced.

The centrally placed recess or pocket 19 of the cartridge of the invention shows no tendency to push out or expel the initiating device 20 because of internal pressure or pressure induced by tamping forces. The film envelope enclosing the initiator is slack and easily accommodates the initiator 20. The pocket 19 closes under internal pressure both before and behind the initiator 20. Thus, equalized longitudinal forces are exerted on the ends of initiators by whatever internal pressure exists or is developed within the cartridge. Both embodiments of the invention shown in the drawings thus provide a stable internal position for the initiator 20 within the cartridges.

I claim:

1. A method of manufacturing an improved flexible film-enveloped explosive cartridge comprising the steps of:

(a) positioning an open-ended tube of flexible film so that it describes upper and lower extremities;

(b) positioning centrally within the said tube a cord-like structure having upper and lower extremities;

(c) closing the lower extremity of said tube so as to firmly grip the lower extremity of the said cord-like structure;

(d) placing in the said tube a quantity of explosive; and (e) closing the upper extremity of said tube so as to firmly grip the said upper extremity of the said cord-like structure so that the said cord-like structure is under longitudinal tension to provide a selected internal cartridge pressure.

* * * * *